United States Patent [19]

Convery

[11] 3,987,332

[45] Oct. 19, 1976

[54] GANG TUNER FOR MULTI-CAVITY KLYSTRON

[75] Inventor: Thomas J. Convery, Belmont, Calif.

[73] Assignee: Varian Associates, Palo Alto, Calif.

[22] Filed: Oct. 9, 1975

[21] Appl. No.: 620,986

[52] U.S. Cl. ..... 315/5.46; 315/5.47; 315/5.48; 315/5.53

[51] Int. Cl.[2] ..... H01J 25/10

[58] Field of Search ..... 315/5.46, 5.47, 5.48, 315/5.43, 5.53, 5.39

[56] References Cited

UNITED STATES PATENTS

| | | | |
|---|---|---|---|
| 2,857,549 | 10/1958 | Beck et al. | 315/5.47 |
| 2,945,156 | 7/1960 | Arnold et al. | 315/5.47 |
| 3,209,200 | 9/1965 | Nelson et al. | 315/5.53 X |
| 3,617,799 | 11/1971 | Schmidt | 315/5.47 |
| 3,838,308 | 9/1974 | Merdinian et al. | 315/5.47 |

*Primary Examiner*—Saxfield Chatmon, Jr.
*Attorney, Agent, or Firm*—Stanley Z. Cole; Richard B. Nelson; Robert K. Stoddard

[57] ABSTRACT

Klystron cavities having linearly movable tuning elements are tuned simultaneously by a single master control which tilts a tuner drive platform. The motion is transmitted to individual cavity tuners by drive elements on the platform at selectable distances from its tilting axis so that the tuning rate of each cavity may be selected for proper tracking with the others. Individual position adjustments of each tuner allow exact setting at a selected reference frequency. The combination of the two sets of independent adjustments permits the resonant frequencies and tuning rates to be independently set at a given reference frequency, or alternately the resonant frequencies may be aligned at two different reference frequencies. Thus the cavity frequencies are made to track during continuous tuning over a wide range.

8 Claims, 6 Drawing Figures

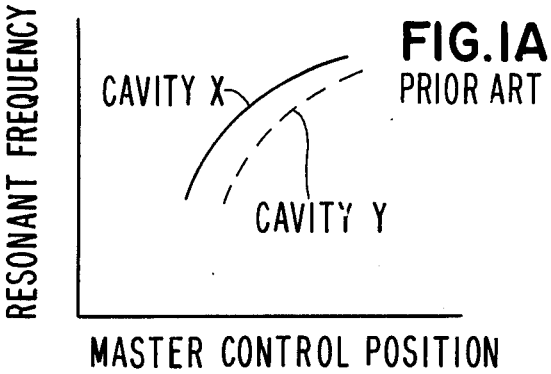
FIG.1A
PRIOR ART
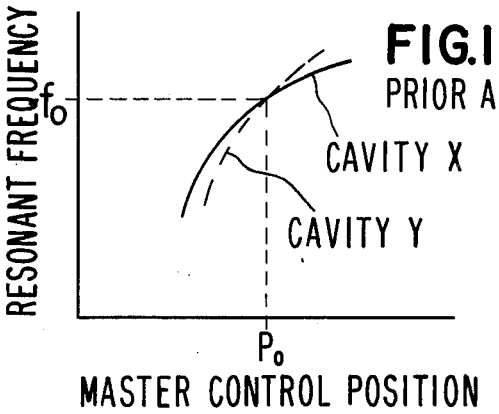
FIG.1B
PRIOR ART
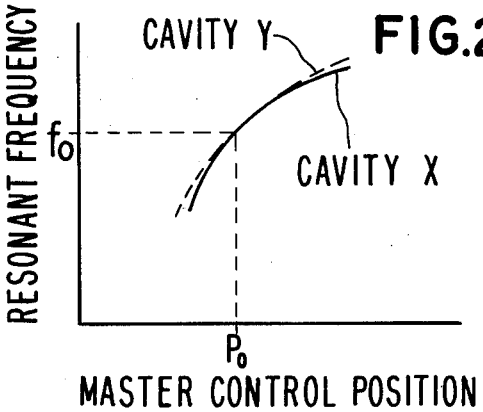
FIG.2
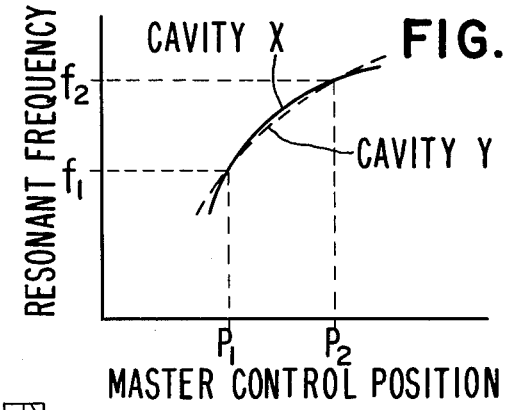
FIG.3
FIG.5
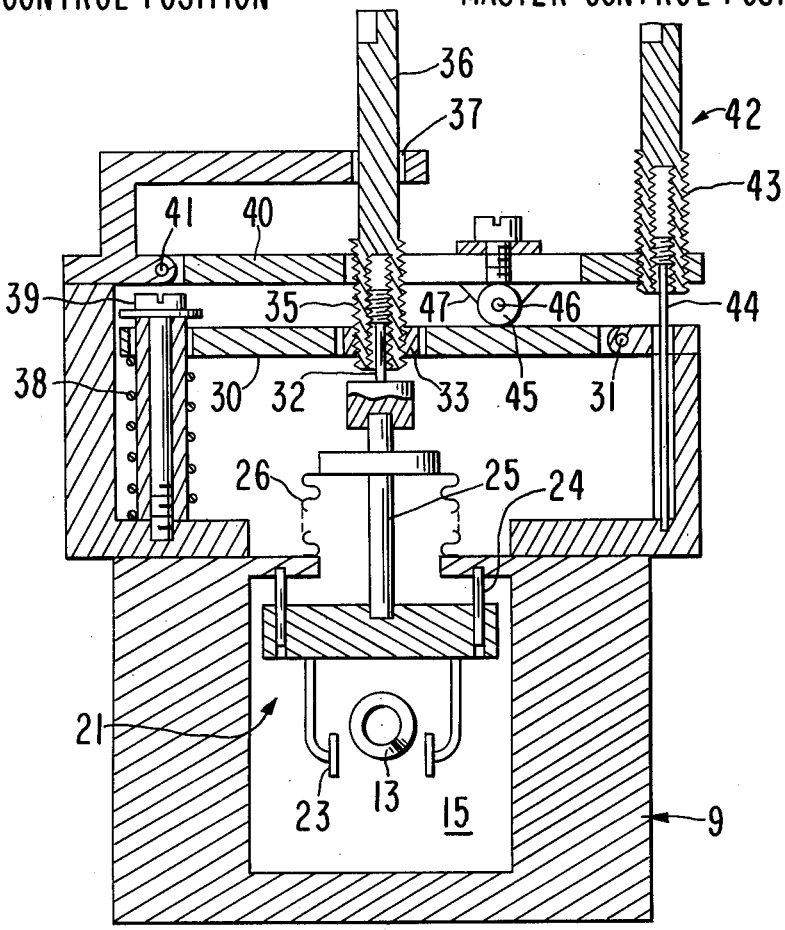

GANG TUNER FOR MULTI-CAVITY KLYSTRON

FIELD OF THE INVENTION

The invention pertains to tunable multi-cavity klystron tubes. When such tubes are tuned from one frequency to another, it is necessary to adjust the resonant frequency of each cavity. The tuning operation usually requires considerable time and skill, particularly if the klystron is to be adjusted for broad band amplification by staggering the resonant cavity frequencies.

PRIOR ART

Simplification of the tuning procedure for klystrons has been tried by various schemes for ganging the individual cavity tuners. The simplest approach has been to apply identical motions to all the tuners. U.S. Pat. No. 3,132,280, issued May 5, 1964, to R. C. Schmidt describes such a scheme. There are several problems left unsolved:

1. Due to manufacturing tolerances, cavities are not all alike and do not have the same resonant frequency for the same tuner positions. (2) Some cavities are functionally different from others. For example, the output and input cavities have their resonant frequencies altered by the coupling impedances of the transmission lines connected to them. Also, intermediate cavities may be loaded to lower their Q's for broad band operation. (3) For broad band tuning, the cavity frequencies are deliberately staggered so that even for indentical cavities returning to a different frequency band does not involve the same amount of motion. These difficulties are hard to overcome because, with known tuning elements, the tuning is non-linear. Therefore, the required motions for a given frequency change vary with the frequency setting.

Prior art klystron designers recognized the need to adjust the tuning rates of the various cavities as well as the tuner position settings for a given reference frequency. U.S. Pat. No. 3,300,679 issued Jan. 24, 1967 to J. A. Brown discloses a gang-tuning drive for tuners which have pivotal motion in which the length of the actuating lever arm from the pivot is settable for each cavity. This tuner proved to have difficulties due to mechanical backlash, sensitivity to shock and vibration, and high manufacturing cost.

U.S. Pat. No. 3,617,799 issued Nov. 2, 1971 to R. C. Schmidt and W. E. Nelson discises a different approach in which the tuners are set to one of a discreet number of preset positions by cam stops. This scheme gives additional flexibility in that at each of the preselected frequencies the tuning can be optimized. However, only a small number of preset frequencies are mechanically feasible.

U.S. Pat. No. 3,838,308 issued Sept. 24, 1974 to G. K. Merdinian and Y. M. Hiramatsu discloses a multiple cam drive in which a continuous, non-linear motion transfer function for each cavity can be set by adjustment of the deformable cams. While this system allows extreme flexibility, it is expensive, takes a long time to preadjust at the factory, and is quite bulky and heavy and thus susceptible to shock and vibrations.

All the above cited patents are assigned to the assignee of the present application.

SUMMARY

An object of the present invention is to provide a multi-cavity klystron which is continuously tunable by a single master control, in which both frequency setting and tuning rate of each cavity are independently adjustable.

Another objective is to provide a leghtweight, rugged gang tuner which is resistant to shock and vibration.

A further objective is to provide a gang tuner of low manufacturing cost which is easily adjustable.

These objectives are realized in present invention by providing a tuner drive platform which is tiltable by the master control about a fixed axis parallel to the tube axis. Motion of the platform is transformed to linear motion of the tuning elements via transfer means actuated by drive elements of the platform located at individually selected distances from the platform axis, whereby individual rates of motion of each tuner with respect to the master control motion may be selected. Individual position adjustments of each tuner allow aligning the cavity frequencies at a selected reference frequency.

BRIEF DESCRIPTION OF DRAWINGS

FIG. 1*a* and FIG. 1*b* illustrate the tuning curves of a pair of klystron cavities.

FIG. 2 shows gang tuning curves achievable with the present invention when both tuning rate and frequency are independently set at the same reference frequency.

FIG. 3 illustrates tuning curves of the present invention when the resonant frequencies are matched at each of two reference points.

FIG. 5 is a section of the klystron of FIG. 4 taken along the line 5—5.

DESCRIPTION OF THE PREFERRED EMBODIMENTS

Figure 4:
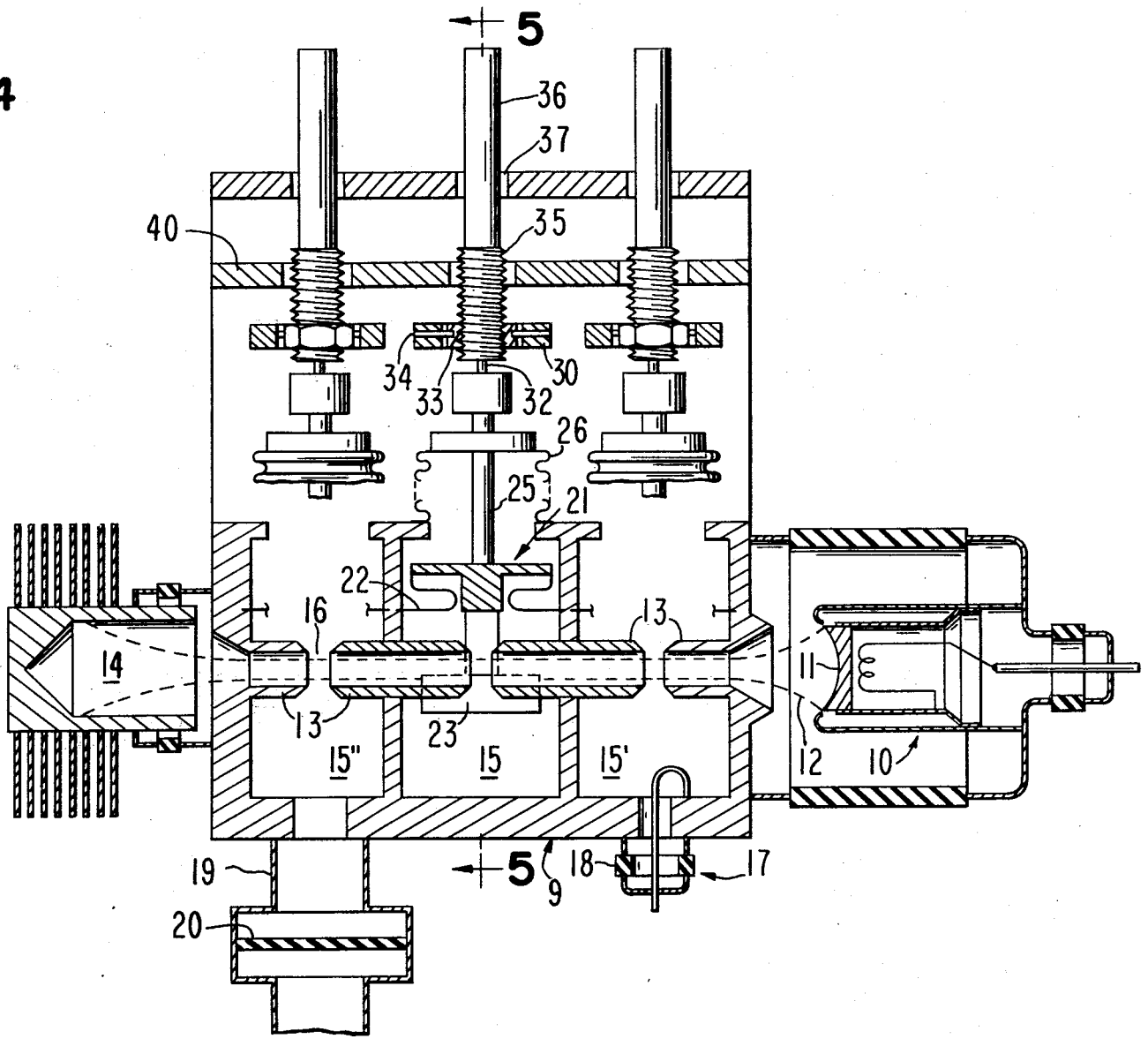
FIG. 4 shows a section, partly schematic, of a klystron comprising the tuner of the present invention.

FIG. 1 illustrates the problem which the present invention solves. In FIG. 1A are shown schematically the tuning curves of two nominally identical cavities. The resonant frequencies are plotted vs. the position of the tuners. If the tuners are ganged to have identical motions, the resonant frequencies may not coincide at any point. In prior art gang tuners, one curve may be moved by a fixed offset mechanical adjustment of its tuner to coincide with the other at a selected center frequency $f_o$. As the master control is then displaced from its position $p_o$ corresponding to $f_o$ the resulting resonant frequencies will deviate as shown in FIG. 1B, because the tuning rates (slopes of the curves) and the shapes of the curves are dissimilar.

FIG. 2 illustrates the improved frequency tracking attainable with the present invention when the relative tuner displacements are set such that the cavities have identical resonant frequencies $f_o$ for a selected position $p_o$ of the master control, and the tuning rates with respect to motion of the master control are also made equal at this point by adjusting the mechanical motion transfer rate.

FIG. 3 shows improved tracking obtainable with the present invention when the displacements and tuning rates are adjusted so that the resonant frequencies $f_1$ and $f_2$ are made equal at each of two selected positions $p_1$ and $p_2$ of the master control, preferably selected near the ends of the tuning range.

FIGS. 4 and 5 illustrate the essentials of a preferred embodiment of the invention. The klystron comprises an electron gun 10 with a concave thermionic cathode 11 arranged to project a cylindrical beam of electrons 12 through drift tubes 13 disposed sequentially along the beam path and thence into a beam collector 14. Resonant cavities 15 in the tube body 9 join the drift tubes to produce electric field in the drift tube gaps 16 for interaction with the electron beam. Microwave energy is coupled into the upstream cavity 15′ by a transmission line 17 through a dielectric window seal 18. Amplified microwave energy is extracted from the downstream cavity 15″ via a coupled waveguide 19 and a dielectric window 20. Each cavity is tuned by a linearly moveable tuning member 21 as described fully in U.S. Pat. No. 2,994,009 issued Sept. 21, 1959 to R. C. Schmidt and R. S. Symons and assigned to the assignee of the present application. This tuner varies the effective inductance of the cavity by deforming a flexible, folded metallic diaphragm 22 which forms the rf wall of the cavity. Simultaneously, capacity plates 23 rigidly connected to the same tuner motion vary the effective capacity between the drift tube tips. The inductive and capacitive effects combine to provide increased tuning range. Tuner element 21 is guided by sliding on two pins 24 and is moved perpendicularly to the tube axis by a rod 25 projecting through a flexible metallic bellows 26 which seals the vacuum envelope. Each tuner is driven by an individual lever 30 pivoted on an axis 31 fixed with respect to tube body 9. To allow tuner 21 to move linearly while lever 30 pivots, the connection of tuner member 21 to lever 30 is through a push rod bar 32 which transmits motion essentially along its axis but is transversely flexible to allow for relative displacement between the linear and the arcuate motions. Push rod 32 is connected to lever 30 through a nut 33 which is mounted on lever 30 via pivot 34 so that only lateral displacement must be accommodated by flexible push rod 32. Joining push rod 32 to nut 33 is a differential screw 35 for individual adjustment of tuner displacement. Screw 35 is actuated by a shaft 36 extending through a deformable bearing 37 as of Teflon, which is rigidly mounted on tube body 9 to restrain lateral displacement of shaft 36.

Motion is transmitted to the individual tuner levers 30 from a tuner drive platform 40. This platform is pivoted on an axis 41 parallel to the tube axis and is tiltable about that axis by a master tuning control 42. Master control 42 is a strut of adjustable length connecting platform 40 to tube body 9. The strut length adjustment is by a differential screw 43 mating platform 40 and a push rod 44. Push rod 44 is transversely flexible to accommodate the arcuate motion of platform 40. Mounted on platform 40 is an individual drive element 45 for each tuner for transferring motion to levers 30. Drive elements 45 in this embodiment are rollers mounted on axles 46 fixed to drive platform 40 to reduce friction due to slight relative displacements as platform 40 and the levers 30 move. Each roller 45 is carried on a carriage 47 which can be set at a point on platform 40 at a pre-selected distance from platform pivot 41. Thus the rate of displacement of each drive element 45 for a given degree of tilt of platform 40 is individually settable. Each drive element roller 45 rests on and transmits motion to one of tuning levers 30. Levers 30 are loaded by compression springs 38 to force them against rollers 45. A limit stop 39 provides for protection against excessive upward motion of lever 30. Other limit stops (not shown) limit the motion of platform 40.

It will be obvious to those skilled in the art that there are many ways to adjust the dimensions of the inventive apparatus to obtain desired tuning curve characteristics. One way that has been found simple and effective is to first set platform 40 and all of the levers 30 to be parallel. In that position, the location of drive element rollers 45 is immaterial. The individual independent adjustments 35 of tuner position are then set to produce the desired klystron frequency response at a preselected frequency, preferably near one end of the tuning range. Then platform 40 is displaced by master control 42 to a point corresponding to a frequency near the other end of the band. At this frequency, the individual rollers 45 are moved along platform 40 to tune the individual cavities 15 for the desired response at this second frequency. Roller carriages 47 are then locked in place. The result of these adjustments is a resonant frequency tracking as illustrated in FIG. 3 which closely approximates perfection.

The above description of the preferred embodiment is intended to be illustrative and not limiting. Many other embodiments of the invention will be obvious to those skilled in the art. For example, the transformation from tilting to linear motion may be achieved by various combinations of linkages and/or flexible transfer members. That is, any pivot may be replaced by a flexible member, and any flexible member may be replaced by one or more pivoted rigid members. Rolling members may be replaced by sliding members or by flexible members. The tuner drive elements 45 may be merely bosses on platform 40 or, alternately, merely locations on platform 40 engaging contact means fastened at adjustable locations on lever 30.

Also it will be obvious that not every one of these adjustments has to be made on every cavity. One of the adjustments may be regarded as fixed on a particular cavity, and the other cavities adjusted to track with it. Low-Q cavities such as output cavities may not need individual adjustment. For manufacturing and adjusting convenience, it has been found advantageous, but not necessary, to have each adjustment settable on each cavity.

I claim:

1. For use with a multi-cavity klystron having tuning members for varying the resonant frequencies of said cavities by linear motion perpendicular to the beam axis of said klystron, a tuner comprising:

drive means for simultaneously activating said linear motion in each cavity by a single master control, and means for setting an individual position of said linear motion of at least one of said tuning members with respect to said drive means, the improvement wherein, said drive means comprises;

a platform tiltable about a platform axis parallel to said beam axis by said master control, and a plurality of pivoted motion transfer means for converting tilting motion of said platform to substantially linear motion of each of said tuning members, each of said motion transfer means being actuated by an individual drive element of said platform located at a preselected distance from said platform axis, at least one of said preselected distances being adjustable.

2. The apparatus of claim 1 wherein each but one of said preselected distances is adjustable.

3. The apparatus of claim 1 wherein said motion transfer means comprises a lever deflectable by said drive element.

4. The apparatus of claim 3 further including a push rod connected at its opposite ends to said lever and said tuning member for transferring motion substantially along the axis of said pushrod, at least one end of said push rod being rigidly connected, a portion of said push rod being transversely flexible to permit arcuate motion of its lever end and linear motion of its tuner end.

5. The apparatus of claim 4 wherein said means for setting said individual position of said linear motion comprises means for adjusting the length of said push rod between said tuning member and said lever.

6. The apparatus of claim 5 wherein said means for adjusting said length comprises a differential screw.

7. The apparatus of claim 1 wherein said master control comprises a strut connecting said platform and the body of said klystron, the length of said strut being adjustable to tilt said platform, a portion of said strut being transversely flexible to permit arcuate motion of said platform.

8. The apparatus of claim 7 comprising differential screw means for adjusting said length of said strut.

* * * * *